US006045193A

United States Patent [19]

Johnson

[11] Patent Number: 6,045,193

[45] Date of Patent: Apr. 4, 2000

[54] COMBINATION MULTIPLE OTTOMANS AND COFFEE TABLE AND METHOD THEREFOR

[76] Inventor: Edward H. Johnson, 9761 E. Pinnacle Vista Dr., Scottsdale, Ariz. 85255

[21] Appl. No.: 09/342,263

[22] Filed: Jun. 29, 1999

[51] Int. Cl.[7] ..... A47C 16/00

[52] U.S. Cl. ..... 297/423.41; 297/440.1; 297/217.1; 297/135

[58] Field of Search ..... 297/217.1, 423.39, 297/423.41, 440.1, 440.14, 463.2, 119, 118, 121, 129, 135, 140, 158.1, 158.2, 158.5, 344.21, 344.26; 108/50.11, 50.14, 59, 60, 64, 66, 157.1, 185; 29/428

[56] References Cited

U.S. PATENT DOCUMENTS

| | | |
|---|---|---|
| D. 143,454 | 1/1946 | White . |
| 433,623 | 8/1890 | Hunzinger . |
| 1,428,275 | 9/1922 | Dahl . |
| 1,493,119 | 5/1924 | Love . |
| 1,701,930 | 2/1929 | Muller . |
| 1,961,457 | 6/1934 | Schneider . |
| 2,030,195 | 2/1936 | Breese . |
| 2,145,201 | 1/1939 | Raeuber . |
| 3,083,052 | 3/1963 | Thorson . |
| 3,232,662 | 2/1966 | Graves . |
| 3,822,078 | 7/1974 | Spadolini . |
| 3,892,441 | 7/1975 | Roeshman . |
| 5,597,199 | 1/1997 | Hoffman et al. . |
| 5,865,501 | 2/1999 | Eisenberg et al. . |

FOREIGN PATENT DOCUMENTS

| | | | |
|---|---|---|---|
| 217815 | 6/1910 | Germany | 297/158.2 |
| 1114016 | 9/1961 | Germany | 297/158.1 |

*Primary Examiner*—Milton Nelson, Jr.
*Attorney, Agent, or Firm*—Harry M. Weiss; Jeffrey Weiss; Paul W. Davis

[57] ABSTRACT

A combination coffee table and ottoman and method, in which four quadrant-shaped ottomans may be selectively deployed as individual combination ottoman/coffee tables or positioned adjacently to form a single combination ottoman/coffee table.

15 Claims, 3 Drawing Sheets

COMBINATION MULTIPLE OTTOMANS AND COFFEE TABLE AND METHOD THEREFOR

BACKGROUND OF THE INVENTION

1. Field of Invention

This invention relates generally to household furniture and, more specifically, to a furniture item that can be converted from a plurality of individually-functioning ottomans to a combined coffee-type table/ottoman and method therefor.

2. BACKGROUND OF THE INVENTION

Ottomans and coffee tables are typical features of the modern living room. Of course, the ottoman is useful as a support for the feet and legs of a person sitting in close proximity thereto. The coffee table, on the other hand, may be used to hold decorative objects or food and drinks. It is noted herein, as is known to those skilled in the art, that even though the term coffee table is used throughout this application, coffee tables also serve as and are interchangeable with end tables, snack tables, etc. which may be located in front of or to the side of a user. Generally, a person decorating a living room must decide whether to position, directly in front of a chair or couch, an ottoman or a coffee table. It is not typically possible to place both directly in front of a user—requiring a person desiring to make both types of furniture available to arrange an ottoman in front of the chair or couch and a table to the side.

There has been at least one effort to address this situation. U.S. Pat. No. 5,597,199, issued to Hoffman, discloses a table that is retractably housed within an ottoman. Although this allows the positioning of a single piece of furniture in front of a chair having both table and ottoman aspects, the apparatus of Hoffman may not be simultaneously used as both an ottoman and a table. Instead, in one configuration it is an ottoman and, in another, it is a table. Moreover, it is only configured to service a single user.

Therefore, a need existed to provide a combination coffee table and ottoman capable of being simultaneously used as both a coffee table and as an ottoman. The combination coffee table and ottoman should, preferably, be capable of serving more than one user. The combination coffee table and ottoman should also, preferably, be configured so that its individual components can be attractively deployed as separate coffee table/ottomans, or joined together in one aesthetically pleasing combination coffee table/ottoman.

SUMMARY OF THE INVENTION

It is an object of the present invention to provide a combination coffee table and ottoman capable of being used as a coffee table and ottoman simultaneously.

It is another object of this invention to provide a combination coffee table and ottoman capable of accommodating more than a single user.

It is a further object of this invention to provide a combination coffee table and ottoman capable of being deployed as separate coffee table/ottomans, or joined together as a single, aesthetically pleasing coffee table/ottoman.

BRIEF DESCRIPTION OF THE PREFERRED EMBODIMENTS

In accordance with one embodiment of the present invention, a combination ottoman and coffee table assembly is disclosed. The combination ottoman and coffee table assembly comprises, in combination: at least two ottomans adapted to be alternatively positioned adjacent to one another and separated from one another; and a finished table surface positioned at a top portion of each of the at least two ottomans.

In accordance with another embodiment of the present invention, a method for providing a combination ottoman and coffee table assembly is disclosed. The method comprises the steps of: providing at least two ottomans adapted to be alternatively positioned adjacent to one another and separated from one another; and providing a finished table surface positioned at a top portion of each of the at least two ottomans.

The foregoing and other objects, features, and advantages of the invention will be apparent from the following, more particular, description of the preferred embodiments of the invention, as illustrated in the accompanying drawings.

DETAILED DESCRIPTION OF THE PREFERRED EMBODIMENTS

Figure 1:
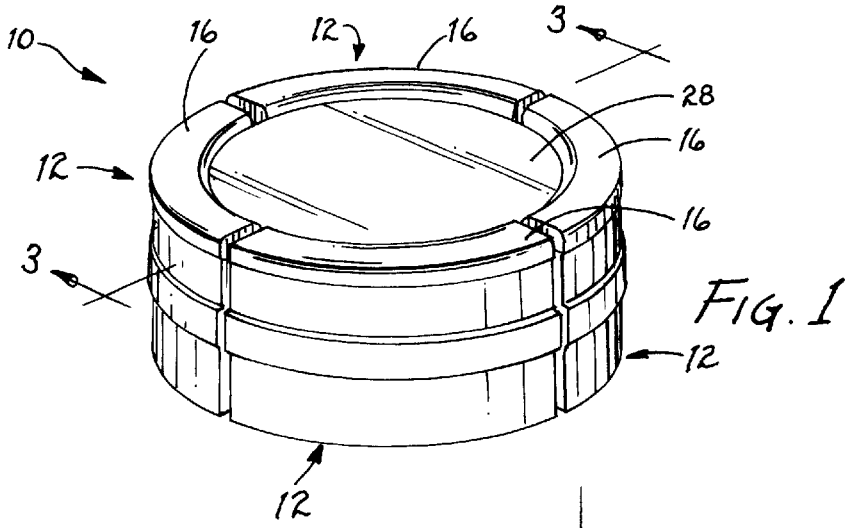
FIG. 1 is a perspective view of the combination ottoman and coffee table assembly of the present invention, shown with the component ottomans positioned adjacent to one another.
Figure 2:
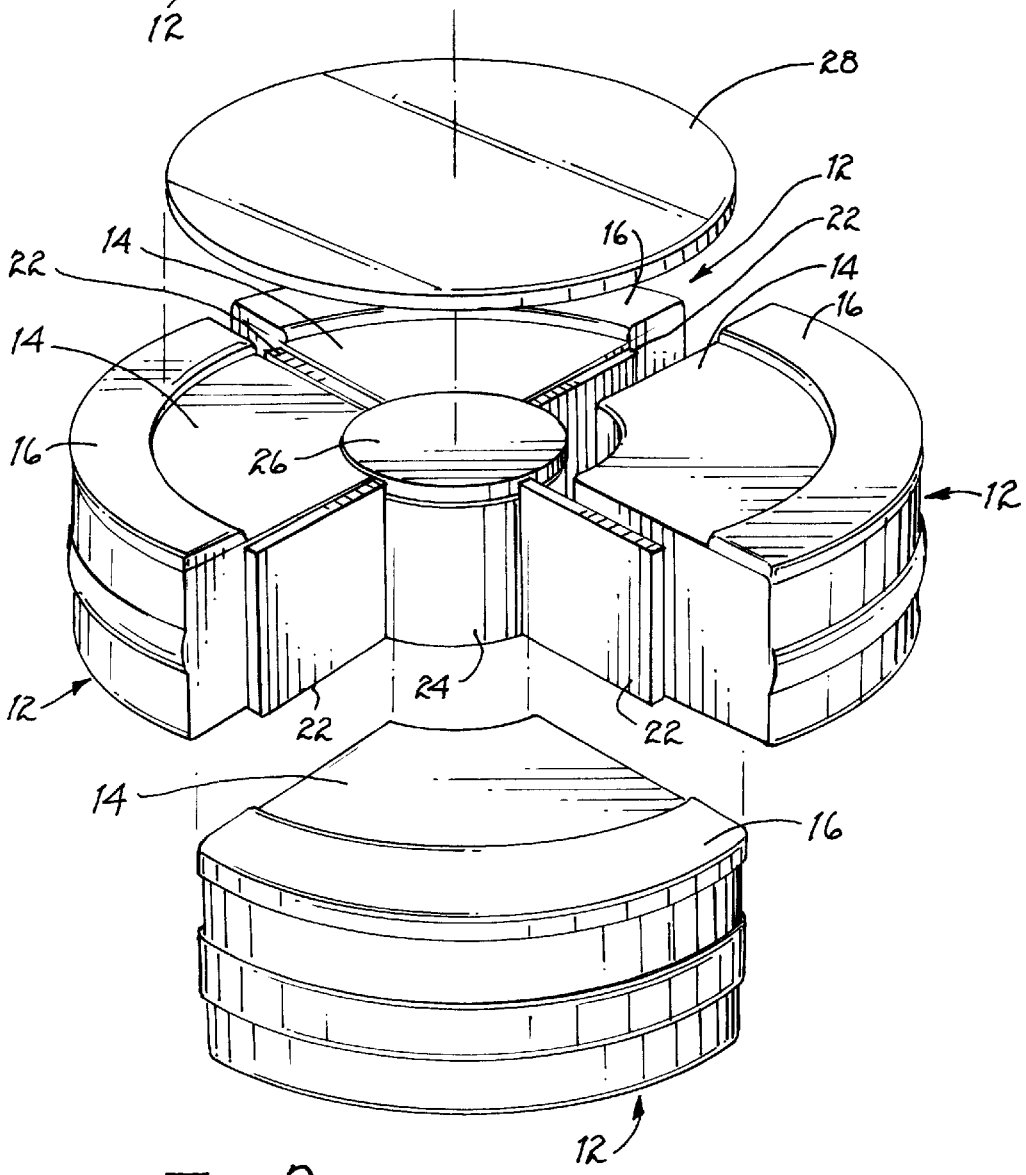
FIG. 2 is a perspective, exploded view of the combination ottoman and coffee table assembly of FIG. 1.
Figure 3:
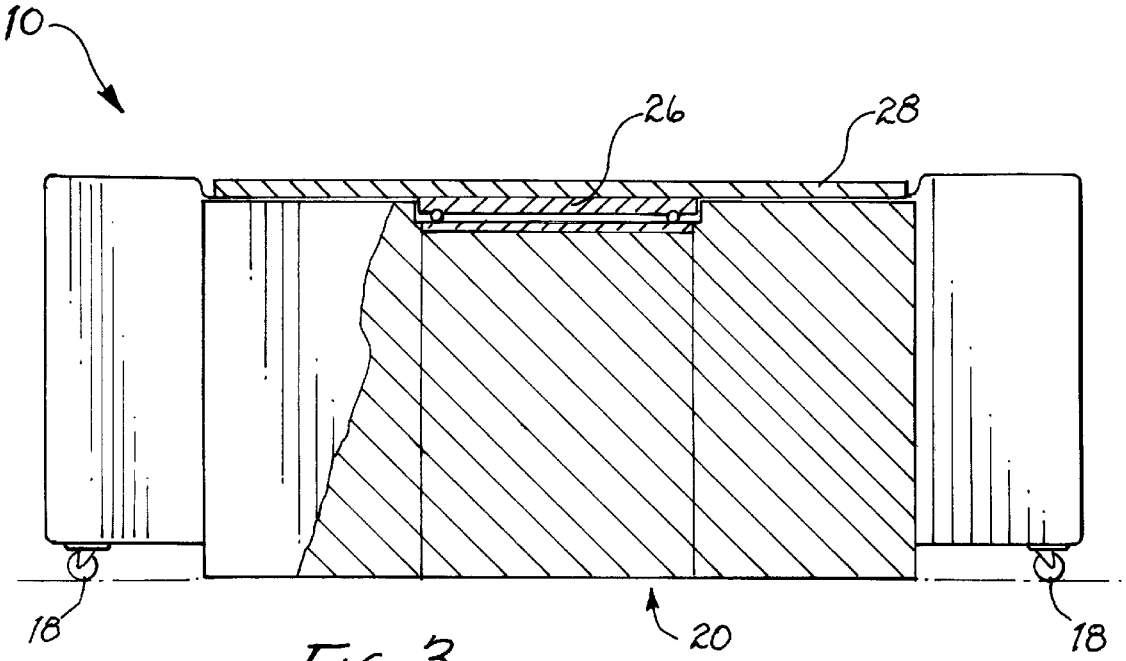
FIG. 3 is a cross-sectional view of the combination ottoman and coffee table assembly of FIG. 1, taken along line 3—3.
Figure 4:
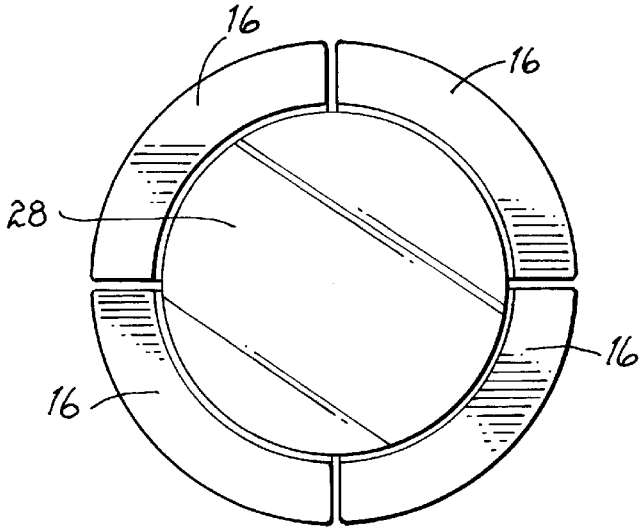
FIG. 4 is a top view of the combination ottoman and coffee table assembly of FIG. 1.

Referring to FIGS. 1–3, reference number 10 refers generally to the combination ottoman and coffee table assembly of the present invention. The combination ottoman and coffee table assembly 10 preferably comprises four individual component ottomans 12. As shown in FIGS. 1 and 2, the component ottomans 12 are preferably substantially quadrant-shaped, so that together they form a circle when placed adjacent to one another as shown in FIGS. 1, 2 and 4. However, without departing from the spirit or scope of this invention, other geometrical configurations for either of or both of the component ottomans 12 and the fully assembled combination ottoman and coffee table assembly 10 are possible. Moreover, while in a preferred embodiment the combination ottoman and coffee table assembly 10 comprises four component ottomans 12, a smaller (as few as two) or larger number of component ottomans 12 may also be provided.

Referring specifically to FIG. 2, each component ottoman 12 preferably comprises on a portion of its upper surface a finished table surface 14, made of any of the types of material that is typically used in the manufacture of coffee tables, end tables, snack tables, etc. Adjacent the finished table surface, around the periphery of the upper surface of each component ottoman 12 is a cushioned area 16, which is designed to receive the feet of a user (not shown) when the component ottoman 12 is in use as an ottoman thus enabling the use of each component ottoman 12 as both an ottoman and/or a coffee/snack/end table. The cushioned area 16 may be covered with leather or vinyl or any other covering material typically used in the manufacture of furniture. The presence of the finished table surface 14 and the cushioned area 16 makes each component ottoman 12, itself, an individual combination coffee table and ottoman. Furthermore, those skilled in the art will recognize that even though the term coffee table is used herein, the component ottoman 12 of the present invention may also serve as an end table, a snack table, etc. any of which are in keeping with the scope and spirit of the present invention.

Figure 5:
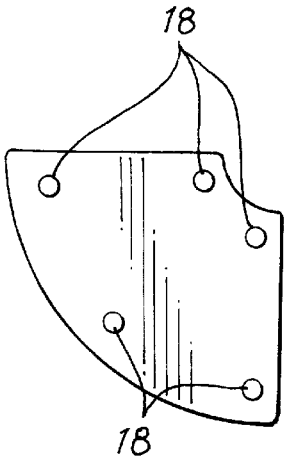
FIG. 5 is a bottom view of a component ottoman of the combination ottoman and coffee table assembly of FIG. 1.

Referring to FIG. 5, each component ottoman 12 preferably has located on a bottom surface thereof a plurality of rollers 18, so as to permit the ready deployment of a component ottoman 12 for individual use as either or both of an ottoman or a table, either in front of or to the side of the user, as well as its return to the configuration shown in FIG. 1 in combination with the other component ottomans 12. The "component ottoman" or "ottoman" when used in reference to the component ottoman 12 herein shall be interpreted to include a table, an ottoman, or a combination of a table and an ottoman.

Referring now to FIGS. 2 and 3, the combination ottoman and coffee table assembly 10 preferably further comprises a positioning member 20. The positioning member 20 preferably contains arms 22, extending from a center area 24, which arms 22 and center area 24 define the space into which each component ottoman 12 should be placed when the combination ottoman and coffee table assembly 10 is fully assembled. Preferably, the center area 24 should include, at a top surface thereof, a "Lazy Susan" 26 which rotates about the top of the center area 24. In a preferred embodiment, a covering table 28 may be positioned upon the "Lazy Susan" 26, so as to cover the "Lazy Susan" 26 and each of the finished table surfaces 14—though not the cushioned areas 16 (See FIGS. 1, 3 and 4). In this manner, when the combination ottoman and coffee table assembly 10 is fully assembled, the cushioned areas 16 may be used as foot/leg rests while, at the same time, the covering table 28—which may be rotated upon the "Lazy Susan" 26, for example as an aid to food service—may be used as a coffee table, snack table, end table, etc.

Figure 6:
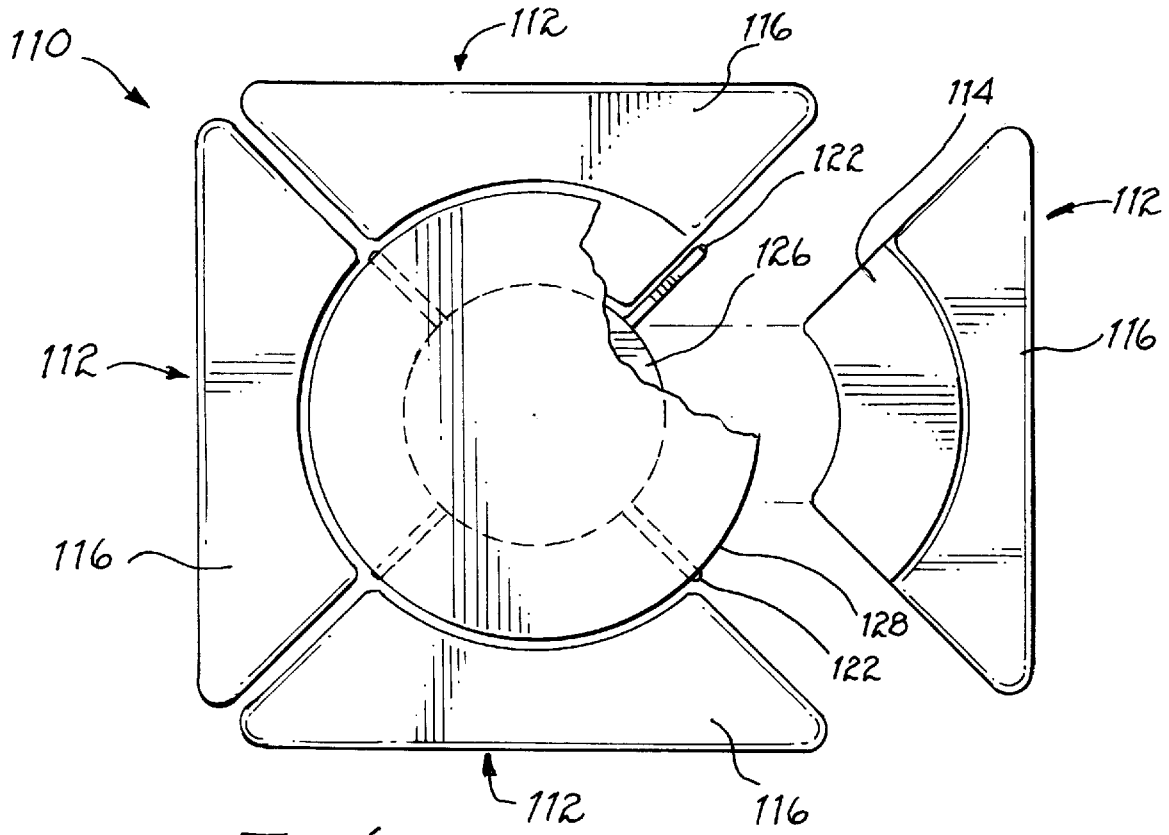
FIG. 6 is a top view of an alternate embodiment of the combination ottoman and coffee table assembly.
Figure 7:
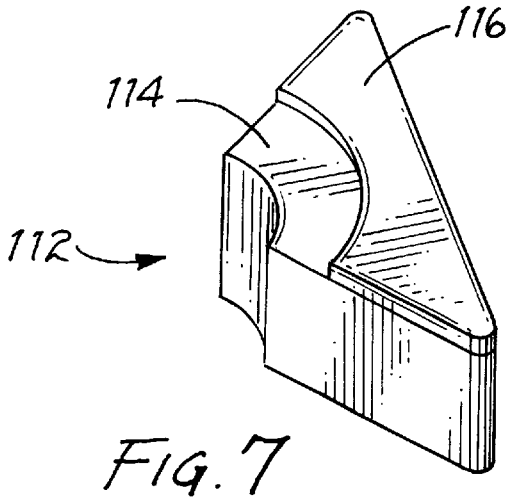
FIG. 7 is a top perspective view of component ottoman of the alternate embodiment combination ottoman and coffee table assembly of FIG. 6.

Referring to FIGS. 6 and 7, an alternate embodiment of the present invention is shown wherein 100's series numerals and symbols represent like 10's series elements as set forth in the previous embodiment. Reference number 110 refers generally to the combination ottoman and coffee table assembly of the alternate embodiment of the present invention. The combination ottoman and coffee table assembly 110 preferably comprises four individual component ottomans 112. As shown in FIGS. 6 and 7, the component ottomans 112 are preferably substantially triangle-shaped, similar to the previous embodiment, except that herein, they together form an essentially square shape when placed adjacent to one another as shown in FIG. 6. As mentioned in the prior discussion concerning a round embodiment, this alternate embodiment is an additional geometrical configuration of the present invention. While in an alternate embodiment the combination ottoman and coffee table assembly 110 comprises four component ottomans 112, a smaller (as few as two) or larger number of component ottomans 112 may also be provided, and the component ottoman 112 may have other than a substantially triangle-shaped configuration.

Each component ottoman 112 preferably comprises on a portion of its upper surface a finished table surface 114, made of any of the types of material that is typically used in the manufacture of coffee tables. Adjacent the finished table surface, around the periphery of the upper surface of each component ottoman 112 is a cushioned area 116, which is designed to receive the feet of a user (not shown) when the component ottoman 112 is in use as an ottoman thus enabling the use of each component ottoman 112 as both an ottoman and/or a coffee/snack/end table. The cushioned area 116 may be covered with leather or vinyl or any other covering material typically used in the manufacture of furniture. The presence of the finished table surface 114 and the cushioned area 116 makes each component ottoman 112, itself, an individual combination coffee table and ottoman. Furthermore, those skilled in the art will recognize that even though the term coffee table is used herein, the component ottoman 112 of the present invention also serves as an end table, a snack table, etc. any of which are in keeping with the scope and spirit of the present invention.

Though not explicitly shown in FIGS. 6 or 7, each component ottoman 112 of the alternative embodiment preferably has located on a bottom surface thereof a plurality of rollers so as to permit the ready deployment of a component ottoman 112 for individual use as either or both of an ottoman or a coffee/snack/end table, as well as its return to the configuration shown in FIG. 6 in combination with the other component ottomans 112. The "component ottoman" or "ottoman" when used in reference to the component ottoman 112 herein shall be interpreted to include a table, an ottoman, or a combination of a table and an ottoman.

The combination ottoman and coffee table assembly 110 preferably further comprises a positioning member 20 as shown in FIG. 3. The positioning member 20 preferably contains arms 122 (FIG. 6), extending from a center area 24 (FIG. 3.) in which arms 122 and center area 24 define the space into which each component ottoman 12 should be placed when the combination ottoman and coffee table assembly 110 is fully assembled. Preferably, the center area 24 (FIG. 3) should include, at a top surface thereof, a "Lazy Susan" 126 which rotates about the top of the center area 24. In an alternative embodiment, a covering table 128 may be positioned upon the "Lazy Susan" 126, so as to cover the "Lazy Susan" 126 and each of the finished table surfaces 114—though not the cushioned areas 116. In this manner, when the combination ottoman and coffee table assembly 110 is fully assembled, the cushioned areas 116 may be used as foot/leg rests while, at the same time, the covering table 128—which may be rotated upon the "Lazy Susan" 126, for example as an aid to food service—may be used as a coffee table, end table, snack table, etc.

As may be observed from the above discussion and FIGS. 1–7, the center area 24 (FIG. 3) is substantially identical for both a preferred embodiment and an alternative embodiment. The essential differences are the outer perimeter shape of each component ottoman 12 and 112. Therefore, not explicitly shown herein, it will be understood that the component ottoman 12 and 112 are in fact interchangeable and mixable. For example, an additional alternative embodiment could have two of the rounded component ottoman 12*s*, and two of the squared off component ottoman 112*s*, or any combination thereof. Thus, utilizing a standard center area 24 as shown in FIG. 3, and a variable combination of differently geometrically shaped component ottomans 12, 112, etc. allows substantial diversity within the present invention.

While the invention has been particularly shown and described with reference to preferred embodiments thereof, it will be understood by those skilled in the art that the foregoing and other changes in form and details may be made therein without departing from the spirit and scope of the invention.

I claim:

1. A combination ottoman and coffee table assembly comprising, in combination:

at least two ottomans adapted to be alternatively positioned adjacent to one another and separated from one another;

a finished table surface positioned at a top portion of each of said at least two ottomans; and a positioning member adapted to position each of said ottomans adjacent to another said ottoman;

wherein said positioning member further comprises a "Lazy Susan" located substantially at a middle portion thereof.

2. The combination ottoman and coffee table assembly of claim 1 further comprising a covering table surface dimensioned to be removably positioned upon said "Lazy Susan" so that said covering table surface may be rotated.

3. The combination ottoman and coffee table assembly of claim 1 wherein said finished table surface is an integral portion of each of said at least two ottomans.

4. The combination ottoman and coffee table assembly of claim 1 wherein each said ottoman is substantially quadrant-shaped, so that when said ottomans are positioned adjacent to one another a circle shape is formed.

5. The combination ottoman and coffee table assembly of claim 1 wherein each said ottoman is substantially triangle-shaped, so that when said ottomans are positioned adjacent to one another a square shape is formed.

6. A combination ottoman and coffee table assembly comprising, in combination:

at least two ottomans adapted to be alternatively positioned adjacent to one another and separated from one another; and a finished table surface positioned at a tog portion of each of said at least two ottomans;

wherein said finished table surface is an integral portion of each of said at least two ottomans;

wherein each said ottoman further comprises a cushion surface adapted to receive a person's legs and located along a perimeter of said top portion adjacent said finished table surface.

7. A combination ottoman and coffee table assembly comprising, in combination:

four ottomans adapted to be alternatively positioned adjacent to one another and separated from one another;

a finished table surface positioned at a top portion of each of said four ottomans; and a positioning member adapted to position each of said ottomans adjacent to another said ottoman;

wherein said positioning member further comprises a "Lazy Susan" located substantially at a middle portion thereof.

8. The combination ottoman and coffee table assembly of claim 7 further comprising a covering table surface dimensioned to be removably positioned upon said "Lazy Susan" so that said covering table surface may be rotated.

9. A method for providing a combination ottoman and coffee table assembly comprising the steps of:

providing four ottomans adapted to be alternatively positioned adjacent to one another and separated from one another;

providing a finished table surface positioned at a top portion of each of said four ottomans; and providing a position in member adapted to position each of said ottomans adjacent to another said ottoman;

wherein said positioning member further comprises a "Lazy Susan" located substantially at a middle portion thereof.

10. The method of claim 9 further comprising the step of providing a covering table surface dimensioned to be removably positioned upon said "Lazy Susan" so that said covering table surface may be rotated.

11. A method for providing a combination ottoman and coffee table assembly comprising the steps of:

providing at least two ottomans adapted to be alternatively positioned adjacent to one another and separated from one another;

providing a finished table surface positioned at a top portion of each of said at least two ottomans; and providing a positioning member adapted to position each of said ottomans adjacent to another said ottoman;

wherein said positioning member further comprises a "Lady Susan" located substantially at a middle portion thereof.

12. The method of claim 11 wherein each said ottoman is substantially quadrant-shaped, so that when said ottomans are positioned adjacent to one another a circle shape is formed.

13. The method of claim 11 wherein said finished table surface is an integral portion of each of said at least two ottomans.

14. The method of claim 11 wherein each said ottoman is substantially triangle-shaped, so that when said ottomans are positioned adjacent to one another a square shape is formed.

15. A method for providing a combination ottoman and coffee table comprising the steps of:

providing at least two ottomans adapted to be alternatively positioned adjacent to one another and separated from one another; and providing a finished table surface positioned at a top portion of each of said at least two ottomans;

wherein avid finished table surface is an integral portion of each of said at least two ottomans; and wherein each said ottoman further comprises a cushion surface adapted to receive a person's legs and located along a perimeter of said top portion adjacent said finished table surface.

* * * * *